US007403172B2

(12) United States Patent
Cheng

(10) Patent No.: US 7,403,172 B2
(45) Date of Patent: Jul. 22, 2008

(54) RECONFIGURABLE PATCH ANTENNA APPARATUS, SYSTEMS, AND METHODS

(75) Inventor: Dajun Cheng, Marlborough, MA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/379,160

(22) Filed: Apr. 18, 2006

(65) Prior Publication Data

US 2007/0241978 A1 Oct. 18, 2007

(51) Int. Cl.
*H01Q 21/00* (2006.01)
*H01Q 1/38* (2006.01)

(52) U.S. Cl. ..... 343/853; 343/700 MS; 343/824; 343/876

(58) Field of Classification Search ..... 343/700 MS, 343/753, 754, 876, 853, 824
See application file for complete search history.

(56) References Cited

U.S. PATENT DOCUMENTS 5,469,181 A 11/1995 Yarsunas
5,767,807 A 6/1998 Pritchett
5,841,401 A 11/1998 Bodley et al.
5,977,911 A 11/1999 Green et al.
6,281,847 B1 8/2001 Lee
6,335,703 B1 1/2002 Chang et al.
6,414,646 B2 7/2002 Luh
6,518,931 B1 2/2003 Sievenpiper
6,567,046 B2 * 5/2003 Taylor et al. ..... 343/700 MS
6,577,282 B1 6/2003 Rao et al.
6,710,746 B1 3/2004 Anderson et al.
6,768,458 B1 7/2004 Green et al.
6,774,854 B2 8/2004 Wannagot et al.
6,784,835 B2 8/2004 Kohno et al.
6,828,938 B2 * 12/2004 Tran ..... 343/700 MS
2004/0155819 A1 * 8/2004 Martin et al. ..... 343/700 MS

OTHER PUBLICATIONS

Cheng, D., "Compact Multi-Band, Multi-Port Antenna", U.S. Appl. No. 11/209,218, filed Aug. 23, 2005.

* cited by examiner

*Primary Examiner*—Hoang V Nguyen
(74) *Attorney, Agent, or Firm*—Schwegman, Lundberg & Woessner, P.A.

(57) ABSTRACT

Embodiments of a beam-reconfigurable patch antenna are described generally herein. Other embodiments may be described and claimed.

23 Claims, 6 Drawing Sheets

RECONFIGURABLE PATCH ANTENNA APPARATUS, SYSTEMS, AND METHODS

TECHNICAL FIELD

Various embodiments described herein relate to electronic communications generally, including apparatus, systems, and methods associated with radio-frequency (RF) antennas.

BACKGROUND INFORMATION

A wireless communication system may include one or more subscriber stations. The subscriber station(s) may communicate with one or more base stations (BS) and/or access points. Following deployment, a base station may require a reconfiguration of an antenna subsystem. Antenna reconfiguration may be required as a geographical distribution of a subscriber base associated with the base station changes, among other causes. In a last-mile fixed wireless application, for example, a service provider may use wireless technology to establish broadband service in a rural area where broadband cable is unavailable. A newly-established coverage area may have fewer subscribers and fewer base stations. It may therefore benefit from a narrow beam width. As a subscriber density increases in the coverage area, additional base stations may be added, and main lobes may be broadened. However, current antenna technologies may require that an antenna be replaced, or at least physically manipulated, to reconfigure cell shapes.

DETAILED DESCRIPTION

Figure 1:
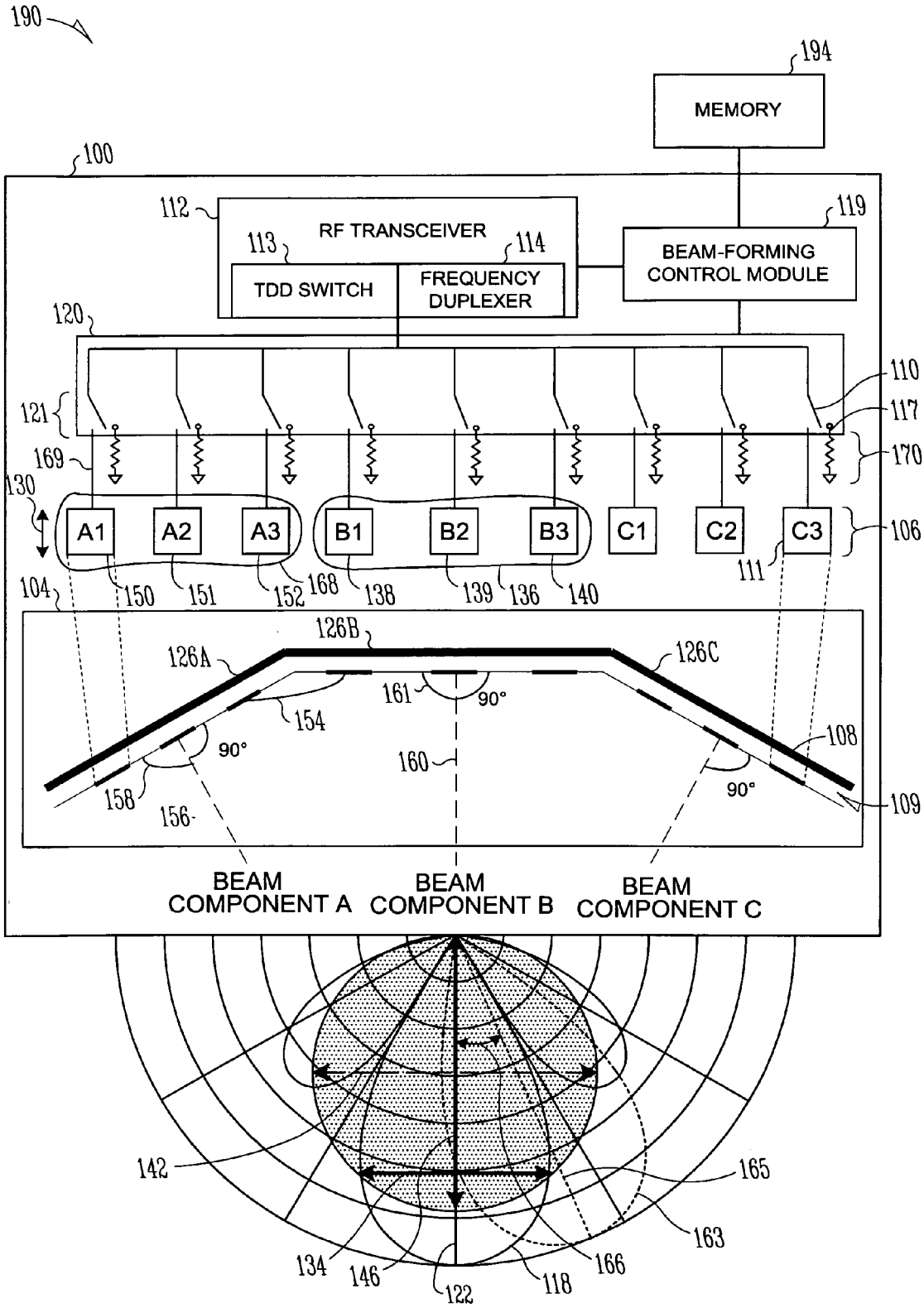
FIG. 1 is a block diagram of an apparatus and a representative system according to various embodiments.

FIG. 1 comprises a block diagram of an apparatus 100 and a system 190 according to various embodiments of the invention. The apparatus 100 may comprise a patch antenna 104. The apparatus 100 may include patch elements 106 separated from a ground plane 108. The patch elements 106 and the ground plane 108 may be separated and electrically insulated from each other by a substrate layer 109 adjacent the ground plane 108. The patch elements 106 may lie adjacent the substrate layer 109, on the opposite side of the substrate layer 109 from the ground plane 108. Various embodiments disclosed herein may comprise a greater or lesser number of the patch elements 106. A size of the patch elements 106 may determine a resonant frequency of the apparatus 100.

The substrate layer 109 may comprise a dielectric substrate. A dielectric constant associated with the substrate layer 109 may be selected to produce a desired bandwidth characteristic. The substrate layer 109 may comprise a plurality of sub-layers, and the sub-layers may be selected to produce a desired bandwidth characteristic. A multi-layer substrate may, for example, increase an operational bandwidth.

One or more of the patch elements 106 may be capable of being selectively energized. In some embodiments, a switch 110 may be located in series between a patch element selected from the patch elements 106 (e.g., the patch element 111) and an RF transceiver 112. The RF transceiver 112 may include a time division duplexing (TDD) switch 113, a frequency duplexer 114, or both. In some embodiments, the TDD switch 113, the frequency duplexer 114, or both may be located separately from the RF transceiver 112. The switch 110 may comprise a single-pole, double-throw switch. The RF transceiver 112 may be selectively connected by the switch 110 to the patch element 111 or to an impedance element 117 to ground. Such arrangement may present a constant impedance to the RF transceiver 112 as the batch element 111 is connected to the RF transceiver 112 and is disconnected therefrom.

Various combinations of the patch elements 106 may be energized to control a shape of a principal electromagnetic energy lobe 118 associated with the apparatus 100. The patch elements 106 may also be used to control a direction of a principal axis 122 of the principal electromagnetic energy lobe 118. A beam-forming control module 119 may be coupled to the RF transceiver 112 to select a desired combination of the patch elements 106. A switching module 120 may be coupled to the beam-forming control module 119 to activate selected ones of a plurality of switches 121.

In some embodiments, the patch elements 106 may be positioned along a shape comprising a plurality of linear segments (e.g., the linear segments 126A, 126B, and 126C). In an alternate embodiment, the patch elements 106 may be positioned along a curved shape. The shape comprising the linear segments 126A, 126B, and 126C and the curved shape may lie substantially in a plane, disregarding a height 130 associated with each of the patch elements 106 and/or a height associated with the ground plane 108. Such embodiments may comprise a radial distribution of the patch elements 106, wherein one or more patch elements of the patch elements 106, including groups of patch elements, are capable of being selectively energized.

Thus configured, the apparatus 100 may operate to control a shape of the principal electromagnetic energy lobe 118, the direction of the principal axis 122 of the principal electromagnetic energy lobe 118, or both. The apparatus 100 may control the direction of the principal axis 122 of the principal electromagnetic energy lobe 118 in a topocentric azimuth plane if positioned horizontally. The apparatus 100 may control the direction of the principal axis 122 of the principal electromagnetic energy lobe 118 in a topocentric altitude plane if positioned vertically.

Particular configurations of energized and de-energized ones of the patch elements 106 may control a beam width 134 associated with the principal electromagnetic energy lobe 118. The beam width 134 may be narrowed by energizing a greater number of patch elements within a cluster of the patch elements 106 (e.g., the cluster 136). The beam width 134 may be widened by energizing fewer patch elements within the cluster 136. For example, assume that patch elements 138, 139, and 140 are energized and produce the principal electromagnetic energy lobe 118. The patch elements 138 and 140 may be de-energized leaving the patch element 139 to produce a wider beam width 142 with a shorter range 146 along the principal axis 122.

Other configurations of energized and de-energized ones of the patch elements 106 may control the direction of the principal axis 122 of the principal electromagnetic energy lobe 118. For example, patch elements 150, 151, and 152 along the linear segment 126A may lie at an angle 154 relative to the patch elements 138, 139, and 140 along the linear segment 126B. The patch elements 150, 151, and 152 may contribute to a beam component 156 emanating at a right angle 158 from the linear segment 126A. The beam component 156 may combine vectorially with a beam component 160 emanating at a right angle 161 from the linear segment 126B. The vectorial sum of the beam components 156 and 160 may result in an energy lobe 163 with a principal axis 165 at an angle 166 relative to the principle axis 122 of the energy lobe 118. Thus, a selectively enabled first cluster of the patch elements 106 lying at an angle relative to a second cluster of the patch elements 106 (e.g., the cluster 168 of the patch elements 106 lying at the angle 154 relative to the cluster 136 of the patch elements 106) may provide a fine level of directional control, a fine level of beam width control, or both, over the principal electromagnetic energy lobe 118. This control may comprise a scanning capability.

In some embodiments, the patch elements 106 may lie along a curved surface, rather than along the segmented linear shape comprising the linear segments 126A, 126B, and 126C, as previously described. In the case of the curved surface, each of the patch elements 106 may lie at a slight angle relative to each adjacent one of the patch elements 106. A curved surface of selectively enabled ones of the patch elements 106 may thus provide a fine granularity of directional control over the principal electromagnetic energy lobe 118.

Figure 2:
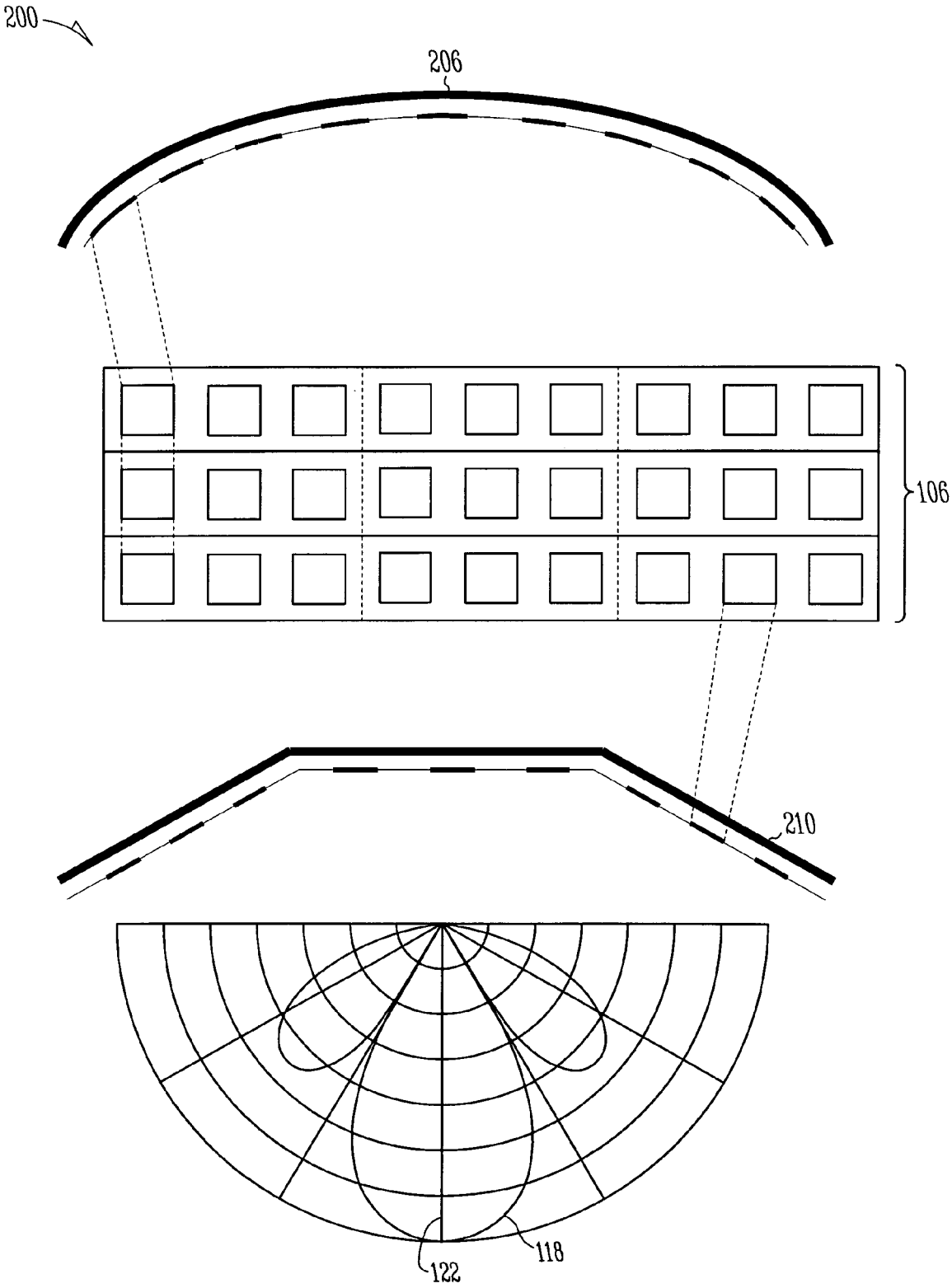
FIG. 2 is a pictorial diagram illustrating a three-dimensional patch antenna according to various embodiments.

FIG. 2 comprises a pictorial diagram of a three-dimensional patch antenna 200. The three-dimensional patch antenna 200 may comprise patch elements 106 positioned across a three-dimensional curved surface 206, a three-dimensional segmented planar surface 210, or both. The patch elements 106 may be selectively enabled to control a shape of a principal electromagnetic energy lobe 118. The patch elements 106 may also be selectively enabled to control a direction of a principal axis 122 of the principal electromagnetic energy lobe 118. If oriented horizontally, the three-dimensional patch antenna 200 may control the direction of the principal axis 122 in a topocentric azimuth plane. If oriented vertically, the three-dimensional patch antenna 200 may control the direction of the principal axis 122 in a topocentric altitude plane.

Figure 3:
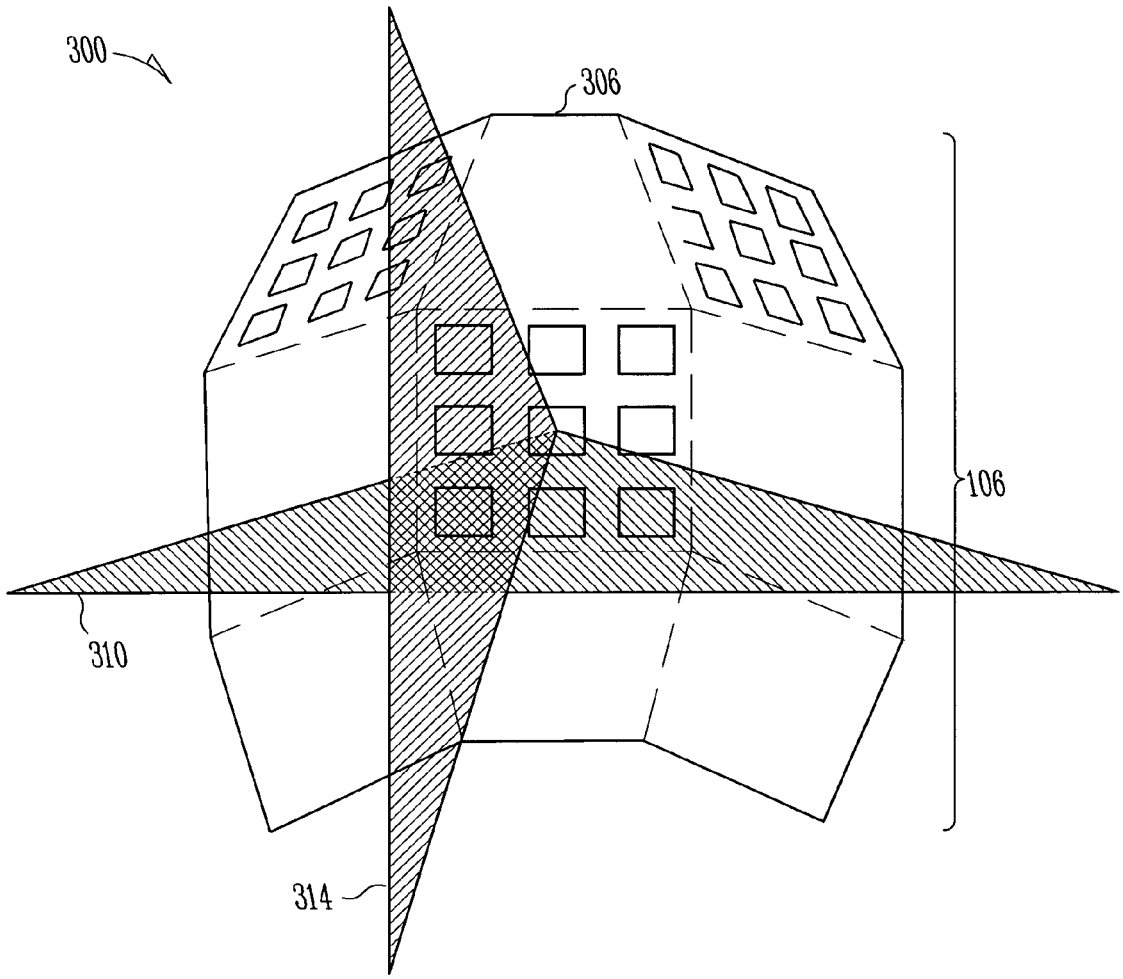
FIG. 3 is a pictorial diagram illustrating a three-dimensional patch antenna according to various embodiments.

FIG. 3 comprises a pictorial diagram of a three-dimensional patch antenna 300. The three-dimensional patch antenna 300 may comprise patch elements 106 positioned across a three-dimensional curved surface (e.g., the three-dimensional curved surface 206 of FIG. 2), a three-dimensional compound planar surface 306, or both. The three-dimensional patch antenna 300 may control the direction of the principal axis 122 in a topocentric azimuth plane 310, in a topocentric altitude plane 314, or both.

Turning back to FIG. 1, in another embodiment, a patch antenna system 190 may include one or more of the apparatus 100, as previously described. The patch antenna system 190 may also include a memory 194 associated with a beam-forming control module 119 coupled to the apparatus 100. The memory may comprise a flash memory, a read-only memory, or a dynamically-refreshed memory, among other types. The patch elements 106 may be operatively coupled to the beam-forming control module 119.

Exercising separate control over each of the plurality of switches 121 and thus selectively enabling or disabling the associated patch elements 106 associated with the patch antenna system 190 may result in a radiation pattern of a reconfigurable gain and beam width. An RF zooming capability may result.

An impedance at a feed line (e.g., the feed line 169) of each of the patch elements 106 together with its associated matching circuit (not shown) may be equal to that of an associated one of a plurality of grounded impedance elements 170. Therefore the input impedance of the patch antenna system 190 may be independent of the status of each one of the plurality of switches 121. The patch antenna system 190 may thus require no further impedance adjustment as the principal electromagnetic energy lobe 118 is zoomed and scanned.

The feed line 169 may utilize a direct probe feeding technique, a direct microstrip line feeding technique, a slot-coupling technique, and/or a direct feed line coupling technique. In some embodiments, the plurality of switches 121 may be located in or on a printed circuit board associated with the feed line 169. Other embodiments may embed the plurality of switches 121 in the substrate layer 109. The plurality of switches 121 may be controlled manually or electronically, and the control mechanism may utilize closed-loop adaptive techniques.

Figure 4:
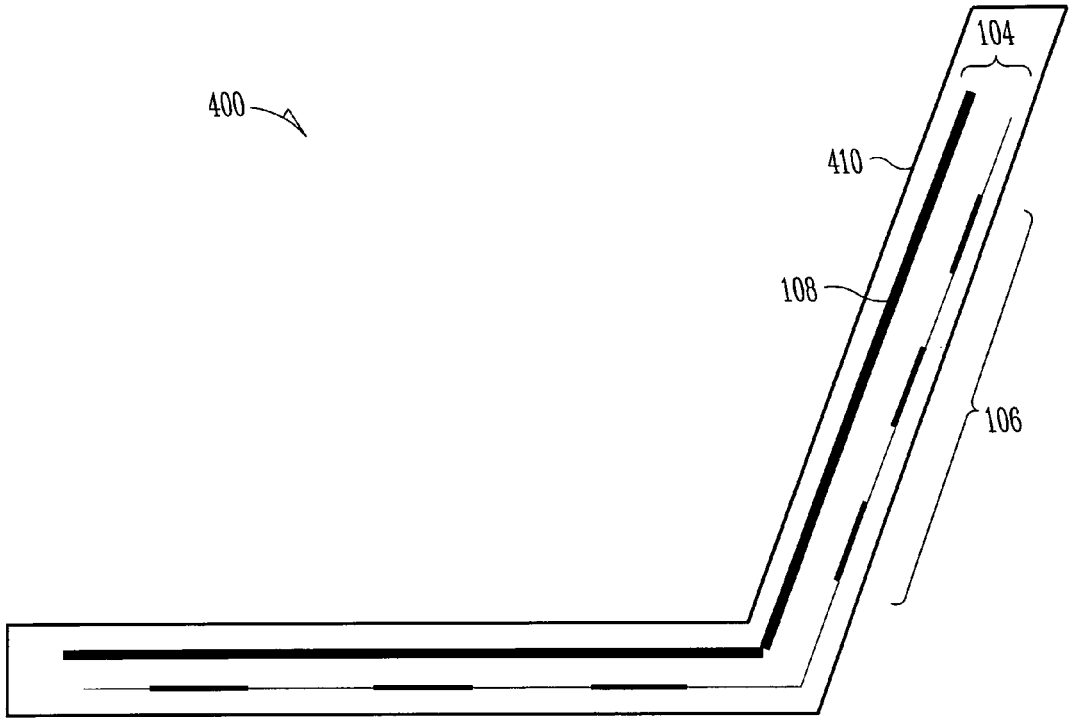
FIG. 4 is a pictorial diagram illustrating a laptop computer according to various embodiments.
Figure 5:
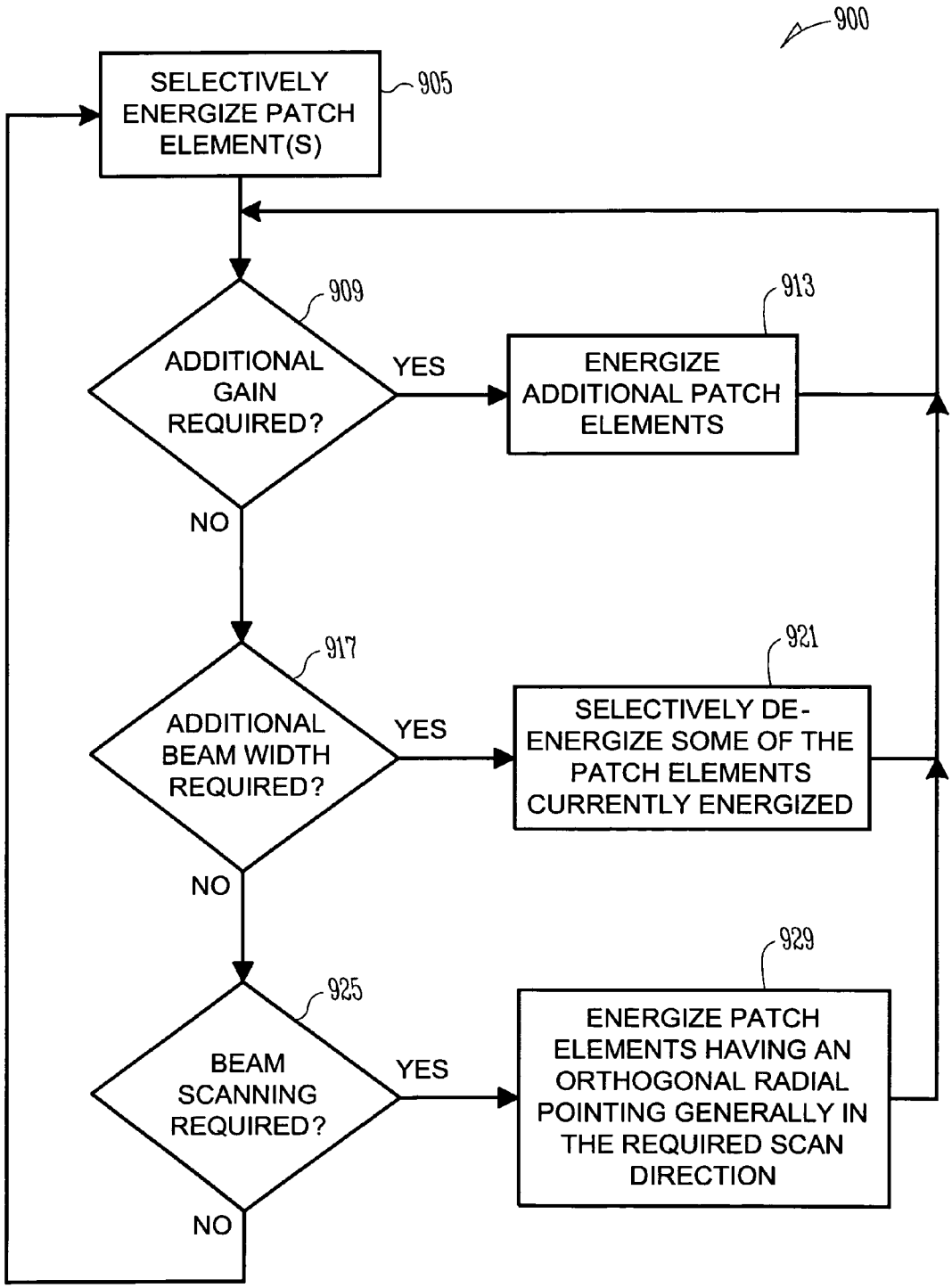
FIG. 5 is a flow diagram illustrating several methods according to various embodiments.

FIG. 4 comprises a pictorial diagram of a laptop computer 400. A subscriber station such as the laptop computer 400 may also benefit from a beam width reconfigurable antenna. For services such as a high-speed downlink packet access and a high-speed uplink packet access, a signal-to-noise plus interference ratio and a gain of the subscriber station antenna may be important to service availability and capability. A reconfigurable patch antenna 104 may be constructed within a display lid 410 of the laptop computer 400. The laptop computer 400 may utilize the patch antenna 104 to adjust the antenna gain and, a beam width, and/or a beam direction as the display lid 410 is re-oriented. This example illustrates that some embodiments of the patch antenna 104 may comprise patch elements 106 configured in a convex arrangement around the ground plane 108.

Any of the components previously described can be implemented in a number of ways, including embodiments in software. Thus, the apparatus 100; the patch antennas 104, 200, 300; the patch elements 106, 111, 138, 139, 140, 150, 151, 152; the ground plane 108; the substrate layer 109; the switches 110, 121; the RF transceiver 112; the time division duplexing switch 113; the frequency duplexer 114; the impedance elements 117, 170; the electromagnetic energy lobes 118, 163; the principal axes 122, 165; the beam-forming control module 119; the switching module 120; the linear segments 126A, 126B, 126C; the height 130; the beam widths 134, 142; the clusters 136, 168; the range 146; the angles 154, 166; the beam components 156, 160; the right angles 158, 161; the curved surface 206; the segmented planar surface 210; the compound planar surface 306; the topocentric azimuth plane 310; the topocentric altitude plane 314; the patch antenna system 190; the memory 194; the feed line 169; the laptop computer 400; and the display lid 410 may all be characterized as "modules" herein.

The modules may include hardware circuitry, single or multi-processor circuits, memory circuits, software program modules and objects, firmware, and combinations thereof, as desired by the architect of the apparatus 100 and the system 190 and as appropriate for particular implementations of various embodiments.

The apparatus and systems of various embodiments may be useful in applications other than producing a reconfigurable principal electromagnetic energy lobe without requiring phase shifters and multiple radio front ends. Thus, various embodiments of the invention are not to be so limited. The illustrations of the apparatus 100 and the system 190 are intended to provide a general understanding of the structure of various embodiments. They are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, single or multi-processor modules, single or multiple embedded processors, multi-core processors, data switches, and application-specific modules, including multilayer, multi-chip modules. Such apparatus and systems may further be included as sub-components within a variety of electronic systems, such as televisions, cellular telephones, personal computers (e.g., laptop computers, desktop computers, handheld computers, tablet computers, etc.), workstations, radios, video players, audio players (e.g., MP3 (Motion Picture Experts Group, Audio Layer 3) players), vehicles, medical devices (e.g., heart monitor, blood pressure monitor, etc.), set top boxes, and others. Some embodiments may include a number of methods.

Figure 6:
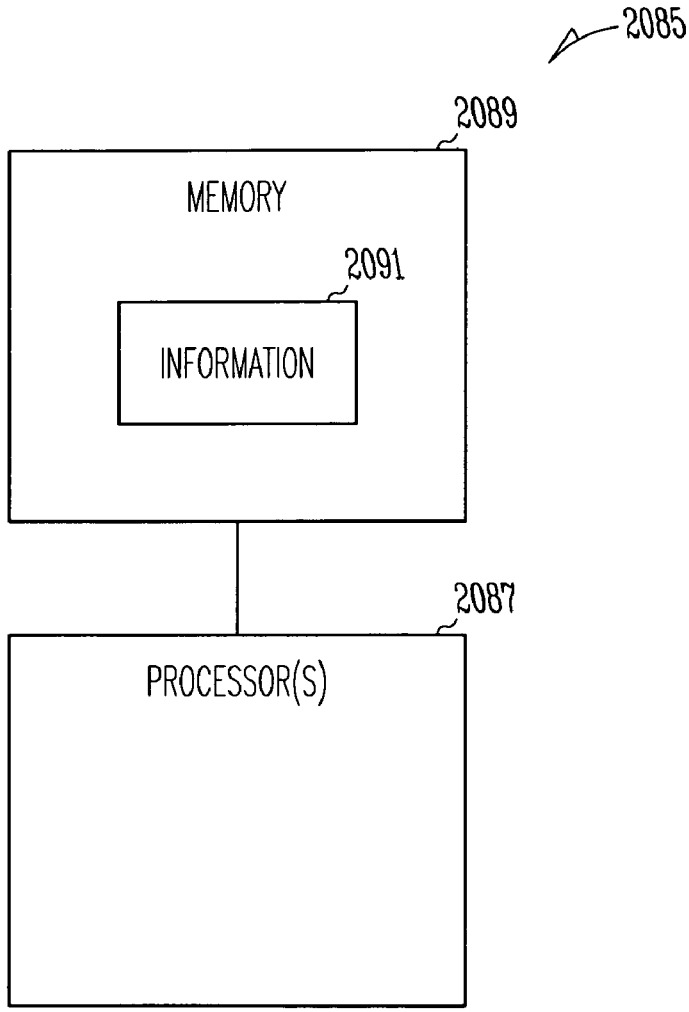
FIG. 6 is a block diagram of an article according to various embodiments.

FIG. 6 is a flow diagram illustrating several methods according to various embodiments. A method 900 may commence at block 905 with selectively energizing one or more patch elements selected from a plurality of patch elements associated with a patch antenna. The patch element(s) may be selectively energized to control a shape of a principal electromagnetic energy lobe associated with the patch antenna, a direction of a principal axis of the principal electromagnetic energy lobe, or both.

The patch antenna may comprise a ground plane, a substrate layer adjacent the ground plane, and the plurality of patch elements adjacent the substrate layer. The plurality of patch elements may be insulated by the substrate layer from the ground plane.

The method 900 may include testing to determine whether additional transceiver system gain is required, at block 909. If additional gain is required, the method 900 may continue at block 913 with energizing additional patch elements. The additional patch elements may be energized within a cluster of patch elements to narrow the shape of the principal electromagnetic energy lobe and to increase the system gain. Gain may be increased along a principal radial associated with the principal electromagnetic energy lobe.

If additional system gain is not required, the method 900 may continue at block 917 with testing to determine whether additional beam width is required. If additional beam width is required, the method 900 may include de-energizing one or more selected patch elements within a cluster of patch elements, at block 921. The patch elements may be de-energized to broaden the shape of the principal electromagnetic energy lobe. The gain along a principal radial associated with the principal electromagnetic energy lobe may be decreased as a result.

If additional beam width is not required, the method 900 may continue at block 925 with determining whether a beam scanning operation is required. The beam scanning operation may be utilized to point the principal electromagnetic energy lobe in a desired direction. If beam scanning is required, the method 900 may include selectively energizing one or more selected patch elements, at block 929. The selected patch elements may lie generally in a plane. The patch elements may be selected such that a radial orthogonal to the plane of the patch elements points generally in the desired direction. If beam scanning is not required, control may be passed to block 905 and the method 900 may repeat.

In some embodiments, the selected patch element(s) may be included within a first cluster of patch elements located substantially in a first plane, a second cluster of patch elements located substantially in a second plane, or both, to control the direction of the principal axis of the principal electromagnetic energy lobe.

The selected patch element(s) may be included in a one-dimensional linear array of patch elements to control the shape of the principal electromagnetic energy lobe. The one-dimensional linear array of patch elements may be oriented horizontally to control the shape of the principal electromagnetic energy lobe in an azimuth plane. Alternatively, the one-dimensional linear array of patch elements may be oriented vertically to control the shape of the principal electromagnetic energy lobe in an altitude plane.

In some embodiments, the selected patch element(s) may be included in a two-dimensional segmented linear array of patch elements, in a two-dimensional curved array of patch elements, or both. Thus arranged, the selected patch element (s) may control the shape of the principal electromagnetic energy lobe, the direction of the principal axis of the principal electromagnetic energy lobe, or both. The two-dimensional segmented linear array of patch elements, the two-dimensional curved array of patch elements, or both may be oriented horizontally. Thus oriented, the shape of the principal electromagnetic energy lobe, the direction of the principal axis of the principal electromagnetic energy lobe, or both may be controlled in an azimuth plane.

Alternatively, the two-dimensional segmented linear array of patch elements, the two-dimensional curved array of patch elements, or both may be oriented vertically. Thus oriented, the shape of the principal electromagnetic energy lobe, the direction of the principal axis of the principal electromagnetic energy lobe, or both may be controlled in an attitude plane.

In some embodiments, the selected patch element(s) may be included in a two-dimensional planar array of patch elements. Thus arranged, the selected patch elements may control the shape of the principal electromagnetic energy lobe in both an azimuth plane and an altitude plane.

In some embodiments, the selected patch element(s) may be included in a three-dimensional segmented planar array of patch elements, a three-dimensional cylindrical array of patch elements, or both. If a cylindrical axis associated with the segmented planar array or with the cylindrical array of patch elements is oriented vertically, the selected patch elements may be used to control the shape of the principal electromagnetic energy lobe in both an azimuth plane and an altitude plane. Thus oriented, the selected patch elements may also be used to control the direction of the principal axis of the principal electromagnetic energy lobe in an azimuth plane.

If the cylindrical axis of the three-dimensional segmented planar array of patch elements or the three-dimensional cylindrical array of patch elements is oriented horizontally, the selected patch elements may be used to control the direction of the principal axis of the principal electromagnetic energy lobe in an altitude plane.

In some embodiments, the selected patch element(s) may be included in a three-dimensional quadric array of patch elements, a three-dimensional compound planar array of patch elements, or both. Thus arrayed, the selected patch element(s) may be used to control the shape of the principal electromagnetic energy lobe, the direction of the principal axis of the principal electromagnetic energy lobe, or both, in both an azimuth plane and an altitude plane.

In some embodiments, a first patch element or a group thereof may be polarized differently than a second patch element or a group thereof. For example, a rectangular, vertically oriented patch element may emit a vertically-polarized signal. A rectangular, horizontally-oriented patch element may emit a horizontally-polarized signal. A signal transmitted using the first and second patch elements or groups thereof may be emitted with a multiple polarization characteristic. Polarizations may include a vertical polarization, a horizontal polarization, a parallel polarization, a right-hand circular polarization, and/or a left-hand circular polarization, among others.

In some embodiments, a first single patch element may be capable of multiple polarization states. For example, a square patch element may emit a signal that is both horizontally and vertically polarized. A patch antenna comprising such dual-state elements may be capable of emitting a signal with a multiple polarization characteristic, including the polarization states previously mentioned, without limitation.

Some embodiments may comprise a third patch element or a group thereof that is sized differently than a fourth patch element or a group thereof. A patch antenna comprising the third and fourth patch elements and/or groups thereof may be capable of multi-band operation, including perhaps a simultaneous multi-band operation.

A second single patch element associated with some embodiments may be capable of operating at multiple frequencies. For example, portions of the second single patch element may be switched in and out of an RF circuit to increase or decrease a size of the second single patch element. A patch antenna comprising such multi-frequency patch elements may be capable of multi-band operation, including perhaps a simultaneous multi-band operation.

Combinations of the aforesaid multi-polarized patch elements, multi-polarized patch groups, multi-band patch elements, and multi-band patch groups may be implemented. Such combinations may result in a multi-band, multi-polarized patch antenna with a principal electromagnetic energy lobe that is of a reconfigurable beam width and gain, and that is steerable.

It may be possible to execute the activities described herein in an order other than the order described. And, various activities described with respect to the methods identified herein can be executed in repetitive, serial, or parallel fashion.

A software program may be launched from a computer-readable medium in a computer-based system to execute functions defined in the software program. Various programming languages may be employed to create software programs designed to implement and perform the methods disclosed herein. The programs may be structured in an object-oriented format using an object-oriented language such as Java or C++. Alternatively, the programs may be structured in a procedure-orientated format using a procedural language, such as assembly or C. The software components may communicate using a number of mechanisms well known to those skilled in the art, such as application program interfaces or inter-process communication techniques, including remote procedure calls. The teachings of various embodiments are not limited to any particular programming language or environment. Thus, other embodiments may be realized, as discussed regarding FIG. 6 below.

FIG. 6 is a block diagram of an article 2085 according to various embodiments of the invention. Examples of such embodiments may comprise a computer, a memory system, a magnetic or optical disk, some other storage device, or any type of electronic device or system. The article 2085 may include one or more processor(s) 2087 coupled to a machine-accessible medium such as a memory 2089 (e.g., a memory including electrical, optical, or electromagnetic elements). The medium may contain associated information 2091 (e.g., computer program instructions, data, or both) which, when accessed, results in a machine (e.g., the processor(s) 2087) performing the activities previously described.

Implementing the apparatus, systems, and methods disclosed herein may electronically reconfigure a principal electromagnetic energy lobe associated with a patch antenna without requiring phase shifters and multiple radio front ends. A beam width and/or a beam direction may be reconfigured. Embodiments herein may decrease costs by enabling a communications service provider to establish a coverage area tailored to current subscribers.

Although the inventive concept may include embodiments described in the exemplary context of an Institute of Electrical and Electronic Engineers (IEEE) standard 802.xx implementation (e.g., 801.11, 802.11a, 802.11b, 802.11e, 802.11g, 802.16, etc.), the claims are not so limited. Additional information regarding the IEEE 802.11 standard may be found in "ANSI/IEEE Std. 802.11, Information technology —Telecommunications and information exchange between systems—Local and metropolitan area networks—Specific requirements—Part 11: Wireless LAN Medium Access Control (MAC) and Physical Layer (PHY) Specifications" (published 1999; reaffirmed June 2003). Additional information regarding the IEEE 802.11a protocol standard may be found in IEEE Std 802.11a, Supplement to IEEE Standard for Information technology—Telecommunications and information exchange between systems—Local and metropolitan area networks—Specific requirements Part 11: Wireless LAN Medium Access Control (MAC) and Physical Layer (PHY) specifications—High-speed Physical Layer in the 5 GHz Band (published 1999; reaffirmed Jun. 12, 2003). Additional information regarding the IEEE 802.11b protocol standard may be found in IEEE Std. 802.11b, Supplement to IEEE Standard for Information technology—Telecommunications and information exchange between systems—Local and metropolitan area networks—Specific requirements—Part 11: Wireless LAN Medium Access Control (MAC) and Physical Layer (PHY) specifications: Higher-Speed Physical Layer Extension in the 2.4 GHz Band (approved Sep. 16, 1999; reaffirmed Jun. 12, 2003). Additional information regarding the IEEE 802.11e standard may be found in "IEEE 802.11e Standard for Information technology—Telecommunications and information exchange between systems—Local and metropolitan area networks—Specific requirements Part 11: Wireless LAN Medium Access Control (MAC) and Physical Layer (PHY) specifications: Amendment 8: Medium Access Control (MAC) Quality of Service Enhancements (published 2005). Additional information regarding the IEEE 802.11g protocol standard may be found in IEEE Std 802.11g™, IEEE Std 802.11g™, IEEE Standard for Information technology —Telecommunications and information exchange between systems—Local and metropolitan area networks—Specific requirements Part 11: Wireless LAN Medium Access Control (MAC) and Physical Layer (PHY) specifications Amendment 4: Further Higher Data Rate Extension in the 2.4 GHz Band (approved Jun. 12, 2003). Additional information regarding the IEEE 802.16 protocol standard may be found in IEEE Standard for Local and Metropolitan Area Networks—Part 16: Air Interface for Fixed Broadband Wireless Access Systems (published Oct. 1, 2004).

Embodiments of the present invention may be implemented as part of a wired or wireless system. Examples may also include embodiments comprising multi-carrier wireless communication channels (e.g., orthogonal frequency division multiplexing (OFDM), discrete multitone (DMT), etc.) such as may be used within a wireless personal area network (WPAN), a wireless local area network (WLAN), a wireless metropolitan area network (WMAN), a wireless wide area network (WWAN), a cellular network, a third generation (3G)

network, a fourth generation (4G) network, a universal mobile telephone system (UMTS), and like communication systems, without limitation.

The accompanying drawings that form a part hereof show, by way of illustration and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. An apparatus, including:

a ground plane;

a substrate layer adjacent the ground plane;

a plurality of patch elements adjacent the substrate layer and insulated by the substrate layer from the ground plane;

a plurality of impedance elements to ground, each impedance element associated with a patch element selected from the plurality of patch elements; and a switch coupled to a radio-frequency (RF) transceiver to selectively connect the RF transceiver to at least one of the patch element or to the impedance element such that a substantially constant impedance is presented to the RF transceiver as the patch element is connected to the RE transceiver and is disconnected therefrom.

2. The apparatus of claim 1, wherein a dielectric constant associated with the substrate layer is selected to produce a desired bandwidth characteristic.

3. The apparatus of claim 1, wherein the substrate layer comprises a plurality of sub layers, the sub layers selected to produce a desired bandwidth characteristic.

4. The apparatus of claim 1, wherein the switch comprises a single-pole, double-throw switch.

5. The apparatus of claim 1, further including:

a beam-forming control module coupled to the RF transceiver; and a switching module coupled to the beam-forming control module to activate the switch.

6. A patch antenna system, including:

a flash memory associated with a beam-forming control module;

a ground plane;

a substrate layer adjacent the ground plane; and a plurality of patch elements operatively coupled to the beam-forming control module, the plurality of patch elements adjacent the substrate layer and insulated by the substrate layer from the ground plane, wherein each patch element of the plurality of patch elements is capable of being selectively energized to control at least one of a shape of a principal electromagnetic energy lobe associated with a patch antenna or a direction of a principal axis of the principal electromagnetic energy lobe.

7. The patch antenna system of claim 6, further including:

a switch in series between a patch element selected from the plurality of patch elements and the RF transceiver, wherein the RF transceiver is selectively connected by the switch to at least one of the patch element or an impedance element to ground such that a constant impedance is presented to the RF transceiver as the patch element is connected to the RF transceiver and is disconnected therefrom.

8. The patch antenna system of claim 6, wherein the switch comprises a single-pole, double-throw switch.

9. The patch antenna system of claim 6, wherein the RF transceiver comprises at least one of a time division duplexing switch and a frequency duplexer.

10. A method, including:

switching a radio-frequency (RF) transceiver between an impedance-matching element to ground and at least one patch element selected from a plurality of patch elements associated with a patch antenna such as to maintain a substantially constant impedance; and selectively energizing the at least one patch element to control at least one of a shape of a principal electromagnetic energy lobe associated with the patch antenna or a direction of a principal axis of the principal electromagnetic energy lobe, wherein the plurality of patch elements are not located in a single plane that is coplanar with each of a plurality of planes associated with the plurality of patch elements.

11. The method of claim 10, wherein the patch antenna comprises a ground plane, a substrate layer adjacent the ground plane, and the plurality of patch elements, wherein the plurality of patch elements lie adjacent the substrate layer and are insulated by the substrate layer from the ground plane.

12. The method of claim 10, further including:

energizing additional patch elements within a cluster of patch elements to narrow the shape of the principal electromagnetic energy lobe and to increase a gain along a principal radial associated with the principal electromagnetic energy lobe.

13. The method of claim 10, further including:

de-energizing ones of the plurality of patch elements within a cluster of patch elements to broaden the shape of the principal electromagnetic energy lobe and to decrease a gain along a principal radial associated with the principal electromagnetic energy lobe.

14. The method of claim 10, wherein the at least one patch element is included within at least one of a first cluster of patch elements located substantially in a first plane or a second cluster of patch elements located substantially in a second plane to control the direction of the principal axis of the principal electromagnetic energy lobe.

15. The method of claim 10, wherein the at least one patch element is included in at least one of a two-dimensional segmented linear array of patch elements or a two-dimensional curved array of patch elements to control at least one of the shape of the principal electromagnetic energy lobe or the direction of the principal axis of the principal electromagnetic energy lobe.

16. The method of claim 15, wherein the at least one of the two-dimensional segmented linear array of patch elements or the two-dimensional curved array of patch elements is oriented horizontally to control the at least one of the shape of the principal electromagnetic energy lobe or the direction of the principal axis of the principal electromagnetic energy lobe in an azimuth plane.

17. The method of claim 15, wherein the at least one of the two-dimensional segmented linear array of patch elements or the two-dimensional curved array of patch elements is oriented vertically to control the at least one of the shape of the principal electromagnetic energy lobe or the direction of the principal axis of the principal electromagnetic energy lobe in an altitude plane.

18. The method of claim 10, wherein the at least one patch element is included in a two-dimensional planar array of patch elements to control the shape of the principal electromagnetic energy lobe in both an azimuth plane and an altitude plane.

19. The method of claim 10, wherein the at least one patch element is included in at least one of a three-dimensional segmented planar array of patch elements or a three-dimensional cylindrical array of patch elements to control the shape of the principal electromagnetic energy lobe in at least one of an azimuth plane or an altitude plane and to control the direction of the principal axis of the principal electromagnetic energy lobe in an azimuth plane, wherein a cylindrical axis associated with the at least one of the three-dimensional segmented planar array of patch elements or the three-dimensional cylindrical array of patch elements is oriented vertically.

20. The method of claim 10, wherein the at least one patch element is included in at least one of a three-dimensional quadric array of patch elements or a three-dimensional compound planar array of patch elements to control at least one of the shape of the principal electromagnetic energy lobe or the direction of the principal axis of the principal electromagnetic energy lobe in both an azimuth plane and an altitude plane.

21. An article including a machine-accessible medium having associated information, wherein the information, when accessed, results in a machine performing:

switching a radio-frequency (RF) transceiver between an impedance-matching element to ground and at least one patch element selected from a plurality of patch elements associated with a patch antenna; and selectively energizing the at least one patch element to control at least one of a shape of a principal electromagnetic energy lobe associated with the patch antenna or a direction of a principal axis of the principal electromagnetic energy lobe, wherein the plurality of patch elements are not located in a single plane that is coplanar with each of a plurality of planes associated with the plurality of patch elements.

22. The article of claim 21, wherein the at least one patch element is included in at least one of a three-dimensional segmented planar array of patch elements or a three-dimensional cylindrical array of patch elements to control at least one of the shape of the principal electromagnetic energy lobe or the direction of the principal axis of the principal electromagnetic energy lobe in an altitude plane and to control the shape of the principal electromagnetic energy lobe in an azimuth plane, wherein a cylindrical axis associated with the at least one of the three-dimensional segmented planar array of patch elements or the three-dimensional cylindrical array of patch elements is oriented horizontally.

23. The article of claim 21, wherein the at least one patch element is included in at least one of a three-dimensional quadric array of patch elements or a three-dimensional compound planar array of patch elements to control at least one of the shape of the principal electromagnetic energy lobe or the direction of the principal axis of the principal electromagnetic energy lobe in at least one of an azimuth plane or an altitude plane.

* * * * *

UNITED STATES PATENT AND TRADEMARK OFFICE

CERTIFICATE OF CORRECTION

PATENT NO. : 7,403,172 B2
APPLICATION NO. : 11/379160
DATED : July 22, 2008
INVENTOR(S) : Cheng It is certified that error appears in the above-identified patent and that said Letters Patent is hereby corrected as shown below:

In column 9, line 61, in Claim 1, delete “RE” and insert -- RF --, therefor.

Signed and Sealed this

Sixteenth Day of September, 2008

JON W. DUDAS
*Director of the United States Patent and Trademark Office*